US006612070B1

(12) United States Patent
Effa

(10) Patent No.: US 6,612,070 B1
(45) Date of Patent: Sep. 2, 2003

(54) FLOWER VASE HOLDER AND METHOD THEREFOR

(75) Inventor: Gerald I. Effa, Irvine, CA (US)

(73) Assignee: Aqua Blooms LLC, Mesa, AZ (US)

( * ) Notice: Subject to any disclaimer, the term of this patent is extended or adjusted under 35 U.S.C. 154(b) by 0 days.

(21) Appl. No.: 10/082,474

(22) Filed: Feb. 22, 2002

(51) Int. Cl.[7] ..... A47C 7/02
(52) U.S. Cl. ..... 47/39; 248/314
(58) Field of Search ..... 47/39, 41.01; 15/435; 248/314, 135

(56) References Cited

U.S. PATENT DOCUMENTS 3,554,384 A * 1/1971 DeNatale ..... 211/94
4,031,663 A * 6/1977 Brunk ..... 47/66.1
D381,044 S * 7/1997 Larm ..... D19/82
6,067,748 A * 5/2000 Williams ..... 47/41.01

FOREIGN PATENT DOCUMENTS

JP 08173290 A * 7/1996 ..... A47G/7/06
JP 10327999 A * 12/1998 ..... A47G/7/04

* cited by examiner

*Primary Examiner*—Charles T. Jordan
*Assistant Examiner*—Susan C. Aliniti
(74) *Attorney, Agent, or Firm*—Jeffrey D. Moy; Harry M. Weiss; Weiss, Moy & Harris, P.C.

(57) ABSTRACT

A holder for supporting a vase in an upright position has a base member. An adhesive is coupled to a bottom surface of the base member. The adhesive is used to coupling the holder onto a surface on which the vase is to be displayed. A holding member is coupled to the base. The holding member is used for holding the vase in an upright position.

9 Claims, 1 Drawing Sheet

FLOWER VASE HOLDER AND METHOD THEREFOR

BACKGROUND OF THE INVENTION

1. Field of the Invention

This invention relates to a flower vase and, more specifically, to a flower vase holder which is able to support a flower vase that holds one or more flower stems in an upright position so that the flower may be displayed.

2. Description of the Prior Art

Many people like to give a single flower to friends or their significant other as a sign of their affection towards that person. Most stores that sell individual flowers place the stem of the flower in a small holder. The holder is generally in the shape of a small test tube. The holder will be filled with water or a sponge type material saturated with water. The stem of the flower is then placed through a small opening in the top of the holder. The holder generally holds enough water to keep the flower watered for at least a day.

The problem with the single stem flower holder is that the bottom of the holder is rounded. Thus, the holder is unable to stand upright so that the flower may be displayed. Even if the bottom of the holder was level, the holder would not be able to support the flower in an upright position since the flower would be too heavy for the holder to support the flower in an upright position.

Therefore, a need existed to provide a flower vase holder. The flower vase holder would be able to support and hold a flower vase in an upright position in order to display the flower.

SUMMARY OF THE INVENTION

In accordance with one embodiment of the present invention, it is an object of the present invention to provide a flower vase holder.

It is another object of the present invention to provide a flower vase holder that would be able to support and hold a flower vase in an upright position in order to display the flower.

BRIEF DESCRIPTION OF THE EMBODIMENTS

In accordance with one embodiment of the present invention a holder for supporting a vase in an upright position. The holder has a base member. An adhesive is coupled to a bottom surface of the base member. The adhesive is used to coupling the holder onto a surface on which the vase is to be displayed. A holding member is coupled to the base. The holding member is used for holding the vase in an upright position.

In accordance with another embodiment of the present invention, a holder for supporting a vase in an upright position is disclosed. The holder has a base member. An adhesive is coupled to a bottom surface of the base member. The adhesive is used for coupling the holder onto a surface on which the vase is to be displayed. A holding member is coupled to the base for holding the vase in an upright position. The holding member is comprised of a column member which is coupled to and extends upward from the base member. A first cavity is formed on a top surface of the column member and extends into the column member. The first cavity is formed so that the first cavity is able to securely hold the vase within the first cavity in an upright position. A card holding device is further formed on the base member for holding a card.

The foregoing and other objects, features, and advantages of the invention will be apparent from the following, more particular, description of the preferred embodiments of the invention, as illustrated in the accompanying drawing.

BRIEF DESCRIPTION OF THE DRAWINGS

The novel features believed characteristic of the invention are set forth in the appended claims. The invention itself, as well as a preferred mode of use, and advantages thereof, will best be understood by reference to the following detailed description of illustrated embodiments when read in conjunction with the accompanying drawings.

DETAILED DESCRIPTION OF THE PREFERRED EMBODIMENT

Figure 1:
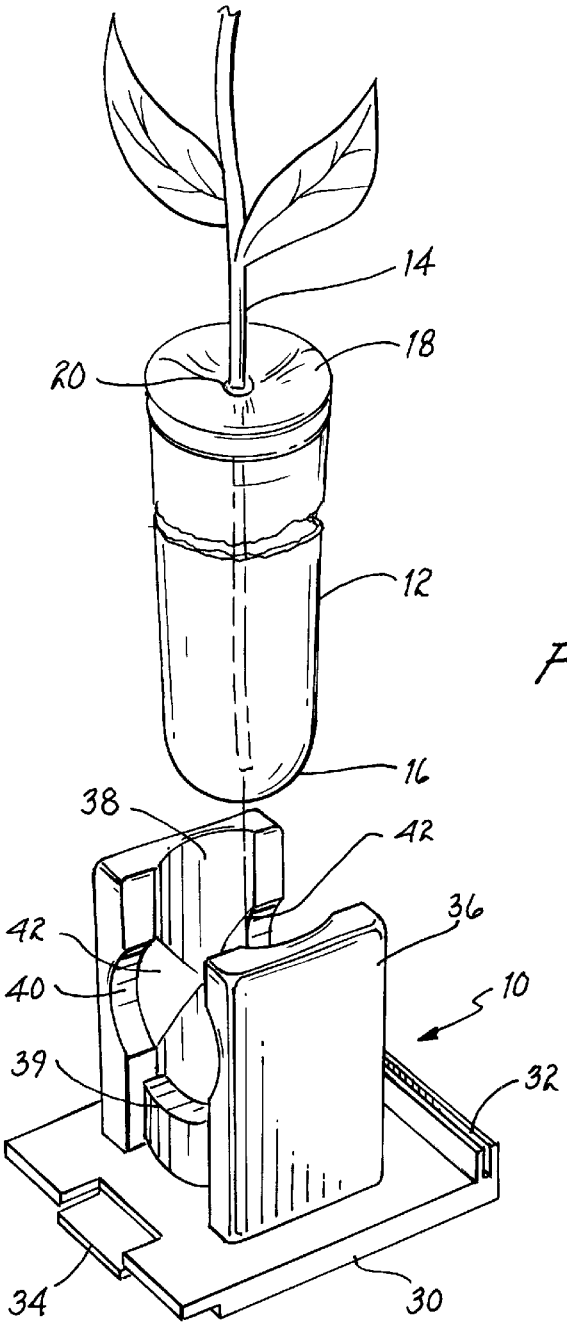
FIG. 1 is an elevated perspective view showing the flower vase holder of the present invention along with the flower vase.
Figure 2:
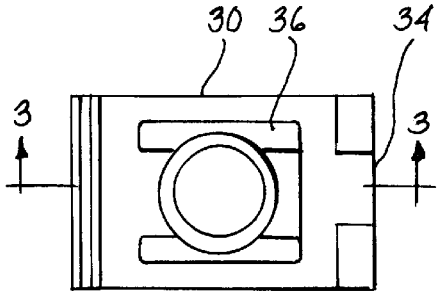
FIG. 2 is a top view of the flower vase holder depicted in FIG. 1.
Figure 3:
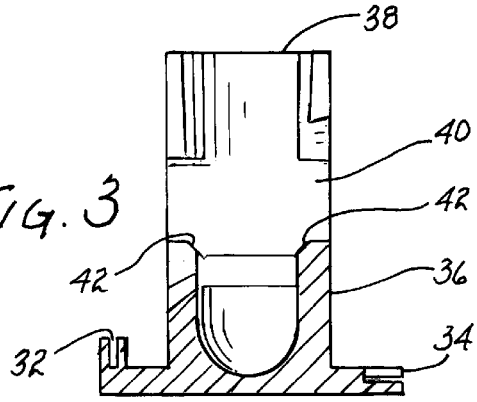
FIG. 3 is a cross-sectional side view of the flower vase holder of the present invention supporting the flower vase in an upright position.

Referring to FIGS. 1–3, a flower vase holder 10 (hereinafter holder 10) is shown. The holder 10 is used to hold and support a vase 12 in an upright position. Thus, the holder 10 allows one to be able to display the flower in the vase 12.

The holder 10 is used to hold a small vase 12 in an upright position. The vase 12 is generally one that is designed to hold a single stem flower 14. However, this should not be seen as to limit the scope of the present invention. The vase 12 is similar in size and shape to that of a test tube. The vase 12 is a circular tube having a rounded and enclosed bottom end 16. The top of the vase 12 is open. A cap 18 is removable coupled to the open end of the vase 12. The cap 18 will have a small opening 20 centrally located on the cap 18. The opening 20 is where the stem of the flower 14 is inserted into the vase 12. Water or a foam and water are generally placed in the vase prior to the cap 18 being coupled to the open end of the vase 12.

The holder 10 allows the vase 12 to stand in an upright position. The holder 10 has a base member 30. The base member 30 may come in a plurality of different shapes and sizes. In the embodiment depicted in the Figures, the base member 30 is rectangular or square in shape. However, this should not be seen as to limit the scope of the present invention. The base allows the holder 10 to be attached to an object/surface (desk, table top, etc.).

An adhesive is placed on a bottom surface of the base member 30. The adhesive will allow the holder to be affixed to the object. The holder 10 may be affixed to a horizontal surface, a vertical surface, or anything in-between. The adhesive may be any type of adhesive. However, double sided adhesive tape is generally used. The double sided adhesive tape should have one side which has an extremely high tack. This side of the double sided adhesive tape would be attached to the base member 30. The other side of the double sided adhesive tape is of the peel and stick nature. Thus, once an outer cover is peeled and removed, a medium tack adhesive layer is exposed. The medium tack adhesive layer will allow one to easily affix the holder 10 to an object/surface and then remove the holder 10 and affix it to another object/surface.

The base member 30 will have one or more devices for holding a card. Cards are generally sent with flowers so that the sender can inscribe a note. The device could also be used to hold business cards and the like. Located along one side of the base member 30 is a raised channeling 32. The raised channeling 32 will extend along the length of the base member 30. The raised channeling 32 will be of a sufficient width to securely hold a card within the raised channeling 32. Located on another side of the base member 30 is a tab section 34. The tab section 34 is formed so that the tab section 34 is formed at a slight distance away from the edge of the base member 30. This will allow a small gap to form which may be used to hold a card. By having two separate devices to hold a card, the holder 10 will be able to hold and display a card whether the holder is coupled to a horizontal or vertical surface.

Extending up from the base member 30 is a vase holding member 36. In the embodiment depicted in the Figures, the vase holding member 36 takes the shape of a column having a square base. However, this should not be seen as to limit the scope of the present invention.

The vase holding member 36 will have a first cavity 38. The first cavity 38 will be formed at the top surface of the vase holding member 36 and extend down towards a bottom section of the vase holding member 36. The first cavity 38 will be of sufficient diameter to securely hold the vase 12 within the first cavity 38. The first cavity 38 is generally used to hold the vase 12 in an upright position when the holder 10 is attached to a horizontal surface. At the bottom of the first cavity 38 will be a ridge member 39. The ridge 39 will help to support the vase 12 when the vase 12 is inserted into the first cavity 38.

A second cavity 40 is formed on a side of the vase holding member 36. The second cavity 40 will extend through the vase holding member 36. The second cavity 40 will be of sufficient diameter to securely hold the vase 12 within the second cavity 40. Ridges 42 may be formed in the interior of the second cavity 40. The ridges 42 are used so that the vase 12 will not protrude out of the opposite end of the second cavity 40 from which the vase 12 was inserted. The second cavity 40 is generally used to hold the vase 12 in an upright position when the holder 10 is attached to a vertical surface.

Figure 4:
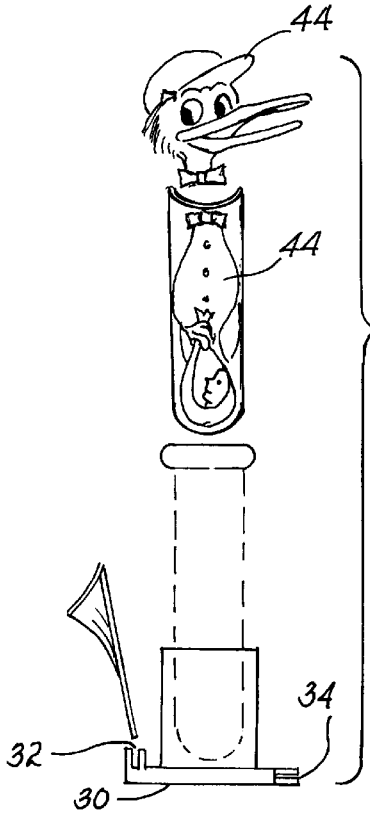
FIG. 4 is a side view showing another embodiment of the flower vase holder of the present invention.

Referring now to FIG. 4, another embodiment of the invention is shown. In this embodiment, the holder 10 and the vase 12 may be decorated. Stickers 44 may be placed on either or both the holder 10 and the vase 12 to decorate the holder 10 and vase 12. The holder 10 and vase 12 may be decorated in a variety of different manners. In the embodiment depicted in FIG. 4, the vase 12 is decorated as a duck. The flower 14 will look as if the flower is coming out of the duck's hat. However, this should not be seen as to limit the scope of the present invention. The holder 10 and/or vase 12 may be decorated in different manners.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A holder for supporting a vase in an upright position comprising:

a base member;

an adhesive coupled to a bottom surface of the base member for coupling the holder onto a surface; and a holding member coupled to the base for holding the vase in an upright position wherein the holding member comprises:

a column member coupled to the base member;

a first cavity formed on a top surface of the column member and extending into the column member, wherein the first cavity is able to securely hold the vase within the first cavity in an upright position;

a second cavity formed on a side of the column member and extending there through, wherein the second cavity is able to securely hold the vase within the second cavity in an upright position when the holder is mounted in an approximately vertical position.

2. A holder for supporting a vase in an upright position in accordance with claim 1 further comprising a card holding device coupled to the base member.

3. A holder for supporting a vase in an upright position in accordance with claim 1 wherein the adhesive is adhesive tape.

4. A holder for supporting a vase in an upright position in accordance with claim 1 wherein the first cavity has a ridge member formed on a bottom section of the first cavity to support the vase when the vase is inserted into the first cavity.

5. A holder for supporting a vase in an upright position in accordance with claim 1 wherein the second cavity has a ridge member formed on an interior section of the second cavity so that the vase will not protrude out of the opposite end of the second cavity from which the vase was inserted.

6. A holder for supporting a vase in an upright position in accordance with claim 2 wherein the card holder comprises a raised channeling formed on an edge of the base member.

7. A holder for supporting a vase in an upright position in accordance with claim 2 wherein the card holder comprises a tab member formed on an edge of the base member.

8. A holder for supporting a vase in an upright position in accordance with claim 1 further comprising stickers for decorating the holder.

9. A holder for supporting a vase in an upright position in accordance with claim 1 further comprising stickers for decorating the vase.

* * * * *